United States Patent [19]

Wolf et al.

[11] 4,369,204

[45] Jan. 18, 1983

[54] INTEGRATED FIRE-RESISTANT FLEXIBLE METAL CONDUCTOR DERIVED INSULATED COATING

[75] Inventors: Alfred A. Wolf; Ernest H. Halpern, both of Annapolis, Md.

[73] Assignee: The United States of America as represented by the Secretary of the Navy, Washington, D.C.

[21] Appl. No.: 343,809

[22] Filed: Jan. 29, 1982

Related U.S. Application Data

[63] Continuation-in-part of Ser. No. 202,976, Nov. 3, 1980, abandoned.

[51] Int. Cl.[3] ..... B05D 3/14

[52] U.S. Cl. ..... 427/13; 427/47; 427/126.6; 427/372.2

[58] Field of Search ..... 427/47, 126.6, 372.2, 427/13

[56] References Cited

FOREIGN PATENT DOCUMENTS 2461201 7/1975 Fed. Rep. of Germany .
52-14602 4/1977 Japan .

*Primary Examiner*—Bernard D. Pianalto
*Attorney, Agent, or Firm*—R. F. Beers; L. A. Marsh

[57] ABSTRACT

A method for preparing a nonflammable insulating sheath on a metal conductor wherein the sheath does not shed, slough off, wipe off, or crack when said conductor is flexed or bent comprising the steps of adding impurities to a metal electrical conductor, zonally annealing said conductor, and rectifying said conductor metallurgically by exposing said conductor to a magnetic or electrical field. The method yields a resultant sheathing on said conductor that does not burn, smoke, smolder, yield toxic fumes or crack during bending or flexing.

10 Claims, 3 Drawing Figures

INTEGRATED FIRE-RESISTANT FLEXIBLE METAL CONDUCTOR DERIVED INSULATED COATING

This is a continuation-in-part of Ser. No. 202,976, filed Nov. 3, 1980 now abandoned.

BACKGROUND OF THE INVENTION

1. Field of the Invention

This invention relates to insulation for a metal conductor, such as, electrical cable. It particularly relates to such a conductor carrying large amounts of electrical energy, such as those utilized in electrical distribution systems. Such electrical distribution systems are especially important for use on ships.

2. Description of the Prior Art

Insulation of a metal conductor, such as, an electrical cable used in electrical distribution systems has been achieved heretofore by coating or covering said conductor with some insulating material. Illustrative prior art examples include enamels, oxides of the conductor, plastic/s, rubber, fiberglass, "TEFLON", neoprene, and polyethylene. Each material has a drawback, however, in certain respects. For example, enamels are thin varnishes which easily scratch and in time craze. Plastics, upon overheating, gives off toxic fumes. Rubber deteriorates with age and "TEFLON" cold-flows to expose the conductor. Further, oxide coatings are hard and not integral and do not adhere well to the wire conductor upon bending. Passivation, an electro-chemical adherence technique wherein an iron, chromium and related metals lose their normal chemical activity after treatment with strong oxidizing agents, such as, nitric acid or enveloping the metal with oxygen during electrolysis has been used to some extent; however, the resulting oxide layers tend to slough off easily thus defeating the insulative properties.

SUMMARY OF THE INVENTION

This invention provides a process for preparing a nonflammable insulating sheath on a metal conductor wherein the sheath does not shed, slough off, wipe off, or crack when said conductor is flexed or bent comprising the steps of adding impurities to a metal electrical conductor, zonally annealing said conductor and rectifying said conductor metallurgically by exposing said conductor to a magnetic or electrical field. The process of this invention provides a conductor sheathing that does not burn, smoke, smoulder, yield toxic fumes or crack during bending or flexing.

More specifically, this invention provides a process for preparing an inorganic insulating coating on an electrical conductor comprising adding an impurity selected from the group consisting of iron oxide, iron sulfide, iron telluride, iron sellenide, molybdenum sulfide, chromium sulfide, cobalt sulfide, cobalt oxide, cobalt telluride, cobalt sellenide, nickel telluride, nickel sellonide and nickel oxide in an amount sufficient to provide an insulating coating that, after subsequent processing, does not burn, smoke, smoulder, yield toxic fumes, or crack during bending or flexing to the melt of a metal electrical conductor, zonally annealing said conductor, and rectifying said conductor metallurgically by exposing said conductor to a magnetic or electrical field.

An object of this invention is to provide an improved process for producing an insulation coating for electrical conductors.

Another object is to provide a process for producing an insulation coating for electrical conductors that does not shed, slough off, or crack during bending or flexing of the conductor.

Other objects, advantages and novel features become apparent from the following detailed description in conjunction with the accompanying drawings, wherein:

DETAILED DESCRIPTION OF THE PREFERRED EMBODIMENT(S)

Figure 1:
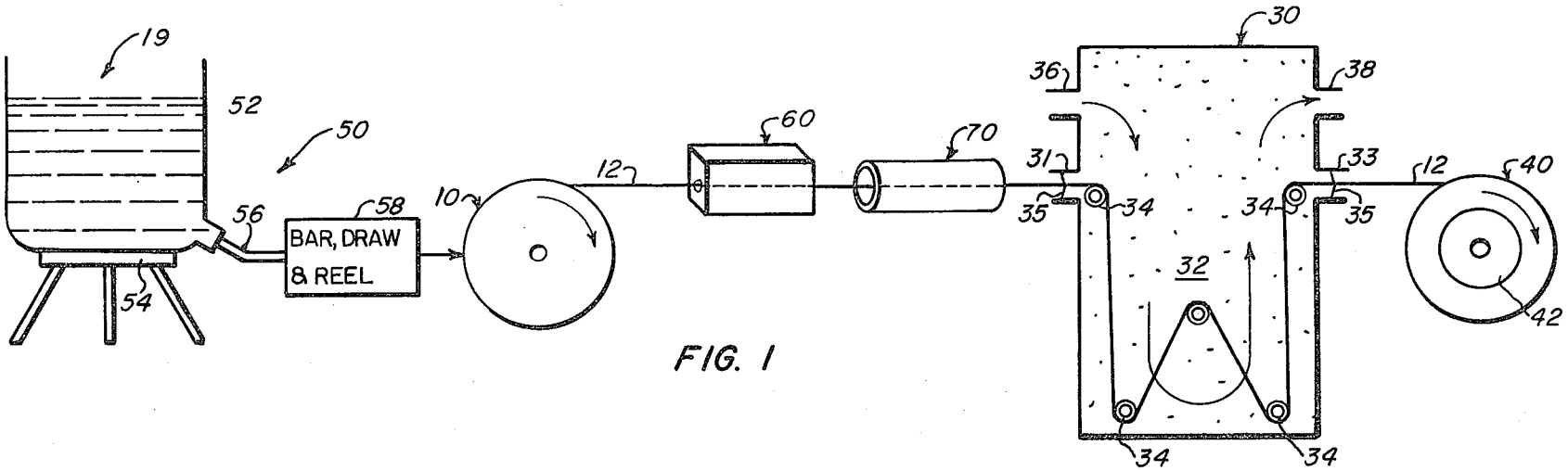
FIG. 1 is a schematic diagram of one embodiment of this invention and illustrates the process of making a metallurgical mixture of the base metal conductor with impurities, and then producing an electrically insulated coating on the conductor.
Figure 2B:
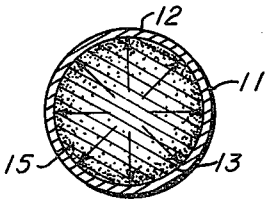
FIG. 2B is a cross-sectional view of the insulated conductor in FIG. 2A.
Figure 2A:
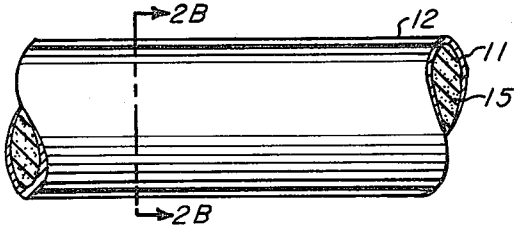
FIG. 2A is a plan view of the resultant insulated conductor according to the invention.

FIG. 1 relates to one embodiment of this invention wherein like reference numerals refer to corresponding items throughout the several views. The illustrated process, sometimes referred to as "the exfusion process", and so called hereinafter is shown. This process illustrates, in sequence, a melting apparatus 19, a wire forming apparatus 50, a reel 10 of treated wire 12, a zonal annealing furnace 60, a magnetic or electrical field generator 70, a sullinating tank 30 (conductor's outer surface made non-coating by an electrical, chemical or mechanical process) and a take-up reel 40. Although generator 70 is shown as following the annealing furnace 60, in practice it is configured in such a manner as to optimize the exfusion process during the annealing step.

In the exfusion process, a conductor is melted along with particles of impurities of controlled size which may be selected from conductive or insulative compounds having the required magnetic or electronic properties. This process uses the metallurgical inclusion of certain impurities in the conductor metal melt. A wire is drawn from the molten metal, after the selected impurities are mixed therewith followed by subjecting said wire to an electrical or magnetic field which produces a migration of the impurities toward the surface of the conductor thus causing an insulating coating to be formed. Several conductive metals, such as, gold, silver, mercury, copper, aluminum and magnesium among others, may be used.

In the exfusion process, elements for inclusion as impurities are selected which have the electron "d" shell unfilled and the "d" electrons unpaired, thereby imparting a magnetic moment to the atom. Examples of such elements and compounds used in this process include any material which can be reduced to micron or submicron size, has either a magnetic dipole moment or an electric dipole moment which will respond to a magnetistatic or electrostatic field, or is misible with the metal of the conductor. Specific examples include oxides, sulfides, tellurides, sillenides of inorganic elements Fe, Co, Ni and other paramagnetic and ferromagnetic materials. The preferred impurities are molybdenum sulfide, chromium sulfide, cobalt sulfide, cobalt oxide, and nickel oxide. Ceramic materials may also be used if they have the proper dipole and misible characteristics. The ratio of impurities (exfusant) to conductor varies, depending upon the materials used and the desired thickness of the insulating coating. An impurity amount of from about 1 to about 1000 parts per ten thousand parts of the melt can be utilized, with amounts of from about 75 to about 125 parts per ten thousand parts of the melt being preferable.

After mixing, the drawn wire strand 12 is zonally annealed in annealing furnace 60. The impurities (exfusant) which has a given electric magnetic dipole moment, in the annealing zone is subjected to an electromagnetic or magnetistatic field as appropriate. Whether the dipole moment is electric or magnetic depends upon the nature of the exfusant material. Such materials are listed and described in the Handbook of Chemistry and Physics, 49th Edition (1968–69), page E-69, published by the Chemical Rubber Company. If the exfusant material forms an electric dipole moment, an electrostatic field is used. If, on the other hand, the material forms a magnetic dipole moment, a magnetistatic field is used. In either case, the dipole moment in the presence of the appropriate field causes a migration of the exfusant particles toward the surface of the wire strand 12. Upon completion of the process, the outermost portion of the strand 12 becomes a pure insulator when the exfusant is an insulating material, with a zone in between the pure conductor and the insulator which contains both conducting and insulating particles.

The insulating properties of the coating depend upon the nature of the exfusant, the annealing temperature, the length of time wire strand 12 is subjected to the field and the magnitude of the field. The field strength must be maintained at such a strength to allow migration of the exfusant only to the surface. The resultant wire strand 12, because the exfusant particles are of micron or submicron size, is flexible and contain properties of nonsmouldering, nonsmoking, nonburning, and nontoxicity.

In the preparation of wire strand 12, pour 56 is processed according to any well known prior art method, such as, dividing pour 56 into bars, and then drawing the bars into wire form in the barring, drawing, and reeling apparatus, represented in FIG. 1, in block diagram form and identified by numeral 58. The wire strand 12 comprising a base-metal mixed with the exfusant is taken up on reel 10 and then fed to annealing furnace 60.

An alternative process step, called sullination, may be used at this point in the process if desired or as an independent process. The sullination process comprises taking the wire strand 12 through a chemical reaction tank 30 as in FIG. 1. If the sullination process is desired to be used with or without the exfusant process, the wire strand 12 is subjected to material to produce a coating in coating tank 30. The wire strand 12 takes a tortuous path over idler rollers 34 so as to obtain sufficient reaction time for proper coating. The wire strand 12 enters port 31 and exits at port 33 and each port preferably contains wiper blades 35 which act as seals to avoid loss of material yet allows wire strand 12 to pass through smoothly.

The sullination process material 32 enters tank 30 through inlet 36 and exits through outlet 38 and may be a gas, such as hydrogen sulfide, hydrogen selenide, or hydrogen telluride, or a liquid, such as hydrosulfidic acid, hydroselenic acid or hydrotelluric acid, or solutions of various salts of the sulphides, seleniles, and tellurides.

The sullination process can be used with silver plated copper wire, nickel, aluminum, titanium, iron and cobalt by the selection of a suitable sullinating agent material as described above. In the case of a specific conductor, the material to be plated onto the conductor must adhere firmly, and the sullination material must be chosen so that the coating formed is both insulating and adherent.

Obviously many modifications and variations of the present invention are possible in the light of the above teachings. It is therefore to be understood that within the scope of the appended claims, the invention may be practiced otherwise than as specifically described.

What is claimed is:

1. A process for preparing an inorganic insulating coating on an electrical conductor comprising adding an impurity selected from the group consisting of iron oxide, iron sulfide, iron telluride, iron sollenide, molybdenum sulfide, chromium sulfide, cobalt sulfide, cobalt oxide, cobalt telluride, cobalt sellenide, nickel telluride, nickel sellenide and nickel oxide in an amount sufficient to provide an insulating coating that, after subsequent processing, does not burn, smoke, smoulder, yield toxic fumes, or crack during bending or flexing to the melt of a metal electrical conductor, zonally annealing said conductor, and rectifying said conductor metallurgically by exposing said conductor to a magnetic or electrical field.

2. A process as in claim 1 wherein said impurity has an atomic structure such that a dipole moment is exhibited.

3. A process as in claim 2 wherein said impurity is added in a finely ground physical state.

4. A process as in claim 3 wherein said finely ground impurity is micron or submicron in size.

5. A process as in claim 2 wherein said dipole moment is a magnetic dipole moment.

6. A process as in claim 2 wherein said dipole moment is an electrical dipole moment.

7. A process as in claim 5 wherein said rectification is carried out in the presence of a magnetic field.

8. A process as in claim 6 wherein said rectification is carried out in the presence of an electrical field.

9. A process as in claim 1 wherein the impurity amount is added to said melt in an amount of from about 75 to about 125 parts per ten thousand parts of said melt.

10. A process as in claim 1 wherein the impurity amount is added to said melt in an amount of from about 1 to about 1000 parts per ten thousand parts of said melt.

* * * * *